US012588701B2

(12) United States Patent
Ahn et al.

(10) Patent No.: US 12,588,701 B2
(45) Date of Patent: Mar. 31, 2026

(54) PAPER TUBE FOR SMOKING ARTICLES WITH FLAVORED SHEET, AND SMOKING ARTICLE

(71) Applicant: KT&G CORPORATION, Daejeon (KR)

(72) Inventors: Ki-Jin Ahn, Daejeon (KR); Dong Hyun Kim, Daejeon (KR); Ick Joong Kim, Daejeon (KR); Kyung Bin Jung, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 378 days.

(21) Appl. No.: 18/032,480

(22) PCT Filed: Nov. 17, 2022

(86) PCT No.: PCT/KR2022/018156

§ 371 (c)(1),
(2) Date: Apr. 18, 2023

(87) PCT Pub. No.: WO2023/090879

PCT Pub. Date: May 25, 2023

(65) Prior Publication Data

US 2025/0072483 A1 Mar. 6, 2025

(30) Foreign Application Priority Data

Nov. 22, 2021 (KR) ..... 10-2021-0161583

(51) Int. Cl.
*A24D 3/04* (2006.01)
*A24D 1/00* (2020.01)
(Continued)

(52) U.S. Cl.
CPC ..... *A24D 3/048* (2013.01); *A24D 1/002* (2013.01); *A24D 1/045* (2013.01); *A24D 1/20* (2020.01);
(Continued)

(58) Field of Classification Search
None
See application file for complete search history.

(56) References Cited

U.S. PATENT DOCUMENTS 6,311,694 B1 * 11/2001 Nichols ..... A24F 13/00 131/191
2003/0178039 A1 9/2003 White et al.
(Continued)

FOREIGN PATENT DOCUMENTS

CN 1154125 A 7/1997
CN 1988815 A 6/2007
(Continued)

OTHER PUBLICATIONS

Definition of paper,Dictionary.com,[online],retrieved from the Internet,[retrieved Sep. 30, 2025],<URL:https://www.dictionary.com/browse/paper. (Year: 2025).*
(Continued)

*Primary Examiner* — Dennis R Cordray
(74) *Attorney, Agent, or Firm* — Sughrue Mion, PLLC

(57) ABSTRACT

The present disclosure relates to a paper tube for smoking articles with a flavored sheet, and a smoking article, and more particularly, relates to a paper tube for smoking articles which includes a flavored sheet including a cellulose-based polymer, a plasticizer, and a flavoring material, and to a smoking article including the same.

9 Claims, 1 Drawing Sheet

(51) Int. Cl.

| | |
|---|---|
| ***A24D 1/04*** | (2006.01) |
| ***A24D 1/20*** | (2020.01) |
| ***A24D 3/10*** | (2006.01) |
| ***A24D 3/14*** | (2006.01) |
| ***A24D 3/16*** | (2006.01) |
| ***A24D 3/17*** | (2020.01) |

(52) U.S. Cl.

CPC ..... *A24D 3/10* (2013.01); *A24D 3/14* (2013.01); *A24D 3/163* (2013.01); *A24D 3/17* (2020.01)

(56) References Cited

U.S. PATENT DOCUMENTS

| | | | | |
|---|---|---|---|---|
| 2004/0237982 | A1* | 12/2004 | Dollhopf | A24D 3/10 131/331 |
| 2008/0006286 | A1 | 1/2008 | Mua et al. | |
| 2021/0161201 | A1* | 6/2021 | Aoun | H05B 6/108 |

FOREIGN PATENT DOCUMENTS

| | | | |
|---|---|---|---|
| CN | 101039597 | A | 9/2007 |
| CN | 104379007 | A | 2/2015 |
| CN | 111187665 | A | 5/2020 |
| EP | 4 276 139 | A1 | 11/2023 |
| GB | 960689 | A | 6/1964 |
| JP | 49-93597 | A | 9/1974 |
| JP | 2008-507972 | A | 3/2008 |
| JP | 2021-503295 | A | 2/2021 |
| JP | 2021-525056 | A | 9/2021 |
| KR | 10-2007-0045327 | A | 5/2007 |
| KR | 10-2013-0117874 | A | 10/2013 |
| KR | 10-2020-0128430 | A | 11/2020 |
| KR | 10-2021-0127980 | A | 10/2021 |
| WO | 2013/046327 | A1 | 4/2013 |
| WO | 2020246036 | A1 | 12/2020 |
| WO | 2021/177023 | A1 | 9/2021 |
| WO | 2021/218811 | A1 | 11/2021 |

OTHER PUBLICATIONS

Extended European Search Report issued Mar. 14, 2024 in European Application No. 22879648.8.

Office Action issued Apr. 24, 2024 in Chinese Application No. 202280007172.4.

Office Action issued May 21, 2024 in Japanese Application No. 2023-516746.

Malte Bille Rask et al., "Comparison of two DSC-based methods to predict drug polymer solubility", International Journal of Pharmaceutics, 2018, pp. 98-105, 540.

International Search Report of PCT/KR2022/018156 dated Feb. 22, 2023 [PCT/ISA/210].

Communication dated Nov. 26, 2024 issued by the Korean Patent Office in application No. 1020210161583.

* cited by examiner

PAPER TUBE FOR SMOKING ARTICLES WITH FLAVORED SHEET, AND SMOKING ARTICLE

CROSS REFERENCE TO RELATED APPLICATIONS

This application is a National Stage of International Application No. PCT/KR2022/018156 filed on Nov. 17, 2022, claiming priority based on Korean Patent Application No. 10-2021-0161583 filed on Nov. 22, 2021.

TECHNICAL FIELD

The present disclosure relates to a paper tube for smoking articles with a flavored sheet, and a smoking article.

BACKGROUND ART

In the case of a heating-type stick product among smoking articles, heating using a dedicated device is essential for an expression of a smoking taste of a medium portion. In the case of devices dedicated for heating-type sticks that have been developed until now to express a smoking taste, a temperature program is designed to enable high-temperature heating in consideration of a heat transfer to the inside of the medium portion. The heating temperature is typically in a range of 200° C. to 400° C. Unlike traditional cigarettes, which enable inhalation by burning cut leaves, a large amount of water vapor is released together when a stick of the medium portion is heated through a device.

The temperature level inside the medium portion through heating ranges from 100° C. to 200° C. Since temperatures of airflows generated inside the medium portion are similar, a smoker may inhale hot air if there is no cooling material downstream of the medium portion.

Polymer materials (e.g., a polylactic acid (PLA), cellulose acetate (CA), poly (ethylene terephthalate) (PET), etc.) which are phase-changeable by absorbing heat within an airflow temperature range, as cooling materials of heating-type sticks that have been developed, are applied to the entire cross section of a filter in the form of a film, and the like, or a hollow tube portion is formed by giving properties of leading a stick into a device by using a paper straw (paper tube) and a tube filter formed of cellulose acetate, and the like, between a most downstream segment and the medium portion, so that airflow may be swirled, thereby providing a cooling effect.

The above polymer materials (e.g., PLA, CA, PET, etc.) are applicable by only a hot dip coating method, do not have flexibility when manufactured in the form of a sheet, and are easily broken due to brittleness, and accordingly it is impossible to directly apply the polymer materials and possible to apply the polymer materials to base paper by only coating.

DISCLOSURE OF THE INVENTION

Technical Goals

To solve the above problems, the present disclosure provides a paper tube for smoking articles that may enhance a quality and taste of a smoking article by applying a flavored sheet with a cooling effect and a flavor expression effect.

The present disclosure provides a smoking article including a paper tube according to the present disclosure.

However, the technical goal obtainable from the present disclosure is not limited to the above-mentioned technical goal, and other unmentioned technical goals may be clearly understood from the following description by one of ordinary skill in the art to which the present disclosure pertains.

Technical Solutions

According to an embodiment of the present disclosure, a paper tube for smoking articles includes a flavored sheet. The flavored sheet may include a cellulose-based polymer, a plasticizer, and a flavoring material.

According to an embodiment of the present disclosure, the cellulose-based polymer may be in an amount of 20% by weight (wt %) to 60 wt % in the flavored sheet.

According to an embodiment of the present disclosure, the plasticizer may be in an amount of 1 wt % to 20 wt % in the flavored sheet.

According to an embodiment of the present disclosure, the flavoring material may be in an amount of 10 wt % to 50 wt % in the flavored sheet.

According to an embodiment of the present disclosure, the cellulose may include at least one selected from a group consisting of methyl cellulose, ethyl cellulose, carboxymethyl cellulose, carboxyethyl hydroxymethyl cellulose, hydroxyethyl cellulose, hydroxypropyl cellulose, hydroxypropylmethyl cellulose, hydroxyethylmethyl cellulose, and agar.

According to an embodiment of the present disclosure, the plasticizer may include at least one selected from a group consisting of propylene glycol, polyethylene glycol, dipropylene glycol, diethylene glycol, triethylene glycol, tetraethylene glycol, glycerin, and sorbitol.

According to an embodiment of the present disclosure, the paper tube may have a resistance to draw of 0.1 $mmH_2O$ to 1.5 $mmH_2O$ per millimeter of a length.

According to an embodiment of the present disclosure, the flavored sheet may have a thickness of 1 mm or less.

According to an embodiment of the present disclosure, the flavored sheet may have a tensile strength of 1.0 kilogram-force (kgf)/15 mm or greater.

According to an embodiment of the present disclosure, the paper tube may have a circumference of 14 mm to 25 mm and a length of 5 mm or greater.

According to an embodiment of the present disclosure, a smoking article includes a filter portion including a paper tube according to the present disclosure.

According to an embodiment of the present disclosure, the smoking article may be a cigarette or an electronic cigarette, and may be in the form of a cigarette.

According to an embodiment of the present disclosure, the filter portion may include a first filter; a second filter including the paper tube; and a third filter including a tube structure.

According to an embodiment of the present disclosure, the first filter may include a fibrous form, a filament form, or both. The fibrous form and the filamentous form may each include at least one of a polymer, paper, cellulose acetate, activated carbon, and carbon.

Effects

In the present disclosure, a flavored sheet may be introduced into a paper tube, to provide an airflow cooling effect and a flavor expression effect, and thus it is possible to enhance persistence of a smoking taste and a tobacco taste. For example, a paper tube into which a flavored sheet is introduced may be disposed downstream of a medium portion of a heating-type tobacco stick, to enhance a cooling effect and the persistence of the smoking taste and the tobacco taste.

BEST MODE FOR CARRYING OUT THE INVENTION

Figure 1:
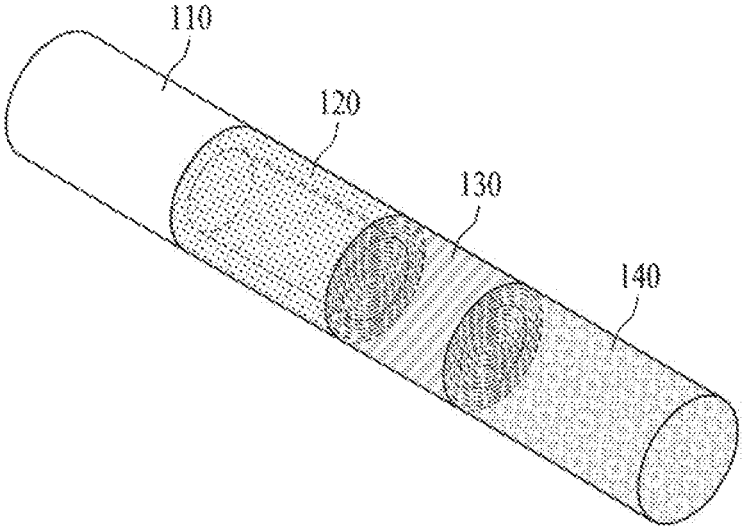
FIG. 1 illustrates an example of a smoking article to which a paper tube according to the present disclosure is applied, according to an embodiment of the present disclosure.

Hereinafter, embodiments of the present disclosure will be described in detail with reference to the accompanying drawings. In the description of the present disclosure, detailed description of well-known related functions or configurations will be omitted when it is deemed that such description will cause ambiguous interpretation of the present disclosure. In addition, the terminologies used herein are for the purpose of appropriately describing example embodiments of the present disclosure, and may vary depending on the intention of users or operators or customs in the art to which the present disclosure belongs. Therefore, terms used herein should be defined based on contents of the entire present specification. The same reference numerals shown in each drawing refer to the same elements.

In the whole specification, when one member is positioned "on" another member, this not only includes a case that the one member is brought into contact with the other member, but also includes a case that another member exists between two members.

It will be understood that when a certain part "includes" a certain component, the part does not exclude another component but may further include another component.

Hereinafter, a paper tube for smoking articles, and a smoking article including the paper tube according to the present disclosure will be described in detail with reference to embodiments and drawings. However, the present disclosure is not limited to the embodiments and drawings.

In the present disclosure, a paper tube for smoking articles is provided. The paper tube may include a flavored sheet, and the flavored sheet may include a cellulose-based polymer, a plasticizer, and a flavoring material. The flavored sheet, which is a film-type sheet, may retain the flavoring material within the cellulose-based polymer to enhance persistence of a flavor and/or tobacco taste spread from a smoking article. In addition, the cellulose-based polymer may provide an airflow cooling effect due to a characteristic of a phase change (e.g., crystallization) only at a temperature (e.g., a high temperature) of an airflow traveling to a smoker in a smoking article, for example, in a stick. In addition, due to a high tensile strength and flexibility of the flavored sheet, the flavored sheet may be applied as a component of a paper tube or a paper tube filter instead of being applied to base paper.

According to an embodiment of the present disclosure, the "smoking article" may refer to any product that may be smoked or any product that may provide a smoking experience, regardless of whether the product is based on tobacco, tobacco derivatives, expanded tobacco, reconstituted tobacco, or tobacco substitutes. For example, the smoking article may refer to an article that may be smoked to generate an aerosol, such as a cigarette, a cigar, a cigarillo, an electronic cigarette (e.g., a heating-type cigarette), and the like. The smoking article may include an aerosol generating material, or an aerosol forming substrate. In addition, the smoking article may include a solid material based on raw tobacco materials, such as reconstituted tobacco sheets, cut tobacco leaves, reconstituted tobacco, and the like. Alternatively, a smoking material may include a volatile compound.

According to an embodiment of the present disclosure, the cellulose-based polymer may be a binder material while providing a polymer matrix for forming a sheet that is flexible, that has a high tensile strength and that is capable of retaining a flavoring material. In addition, for example, the cellulose-based polymer may be used together with ethyl alcohol and a solvent (e.g., water) used to dissolve and/or disperse ingredients for forming a film and/or a sheet. The cellulose-based polymer may include, for example, at least one selected from a group consisting of methyl cellulose, ethyl cellulose, carboxymethyl cellulose, carboxyethyl cellulose, hydroxymethyl cellulose, hydroxyethyl cellulose, hydroxypropyl cellulose, hydroxypropylmethyl cellulose, hydroxyethylmethyl cellulose, and agar, but is not limited thereto. Desirably, the cellulose-based polymer may be methyl cellulose and hydroxypropylmethyl cellulose.

According to an embodiment of the present disclosure, the cellulose-based polymer may be in an amount of 20% by weight (wt %) to 60 wt %; 20 wt % to 50 wt %; or 30 wt % to 40 wt % in the flavored sheet. If the amount of the cellulose-based polymer is less than 20 wt %, it may be difficult to obtain a tensile strength and flexibility that allow the cellulose-based polymer to be applied as a component of a paper tube or a paper tube filter, or difficult to generate a sheet itself. If the amount of the cellulose-based polymer exceeds 60 wt %, it may be difficult to enhance persistence of a smoking taste and a tobacco taste because an aroma and flavor are not sufficiently expressed from a flavoring material in a sheet due to a change (e.g., breaking, and cracking) in physical properties of the sheet.

According to an embodiment of the present disclosure, as the flavoring material, all materials capable of imparting flavor and/or aroma characteristics or enhancing an aromatic taste of smoking and applicable to a smoking article may be used without limitation. The flavoring material may include, for example, at least one selected from a group consisting of an organic acid, such as a lactic acid, a citric acid, a malic acid, and the like, licorice, sucrose, fructose syrup, isosweet, cocoa, lavender, cinnamon, cardamom, celery, fenugreek, cascarilla, white sandalwood, bergamot, geranium, honey essence, rose oil, vanilla, lemon oil, orange oil, mint oil, cinnamon, caraway, cognac, jasmine, chamomile, menthol, *cassia*, ylang-ylang, *salvia*, spearmint, ginger, cilantro, a clove extract (or a clove material), and coffee, but is not limited thereto.

According to an embodiment of the present disclosure, the flavoring material may be in an amount of 10 wt % to 50 wt %; 10 wt % to 40 wt %; 10 wt % to 30 wt %; or 10 wt % to 20 wt % in the flavored sheet. If the amount of the flavoring material is within the above range, persistence of a flavor and/or tobacco taste that spread may be provided and the flavoring material may be applied at a high concentration, to adjust an intensity of an aroma and/or flavor.

According to an embodiment of the present disclosure, the plasticizer may include at least one selected from a group consisting of propylene glycol, polyethylene glycol, dipropylene glycol, diethylene glycol, triethylene glycol, tetraethylene glycol, glycerin, and sorbitol, but is not limited thereto. Desirably, the plasticizer may be propylene glycol and glycerin.

According to an embodiment of the present disclosure, the plasticizer may be in an amount of 1 wt % to 20 wt %; 1 wt % to 15 wt %; 1 wt % to 10 wt %; or 5 wt % to 10 wt % in the flavored sheet to adjust a strength of the flavored sheet. If the amount of the plasticizer is less than 1 wt %, it may be difficult to have a tensile strength suitable to apply the plasticizer as a component of a paper tube or a paper tube filter of a smoking article, or difficult to have a flexibility due to an extremely low extension rate. If the amount of the plasticizer exceeds 20 wt %, a sheet may be easily torn due to poor physical properties of the sheet (e.g., a tensile strength may be reduced, or the sheet may be excessively softened), and accordingly it may be difficult to manufacture the sheet as a paper tube filter of a smoking article.

According to an embodiment of the present disclosure, the flavored sheet may have a thickness of 1 millimeter (mm) or less; 0.1 mm to 1 mm; 0.1 mm to 0.8 mm; or 0.2 mm to 0.5 mm. The flavored sheet may include a single layer or a plurality of layers. If the thickness of the flavored sheet exceeds 1 mm, it may be difficult to manufacture a sheet as a paper tube of a smoking article because a flexibility of the sheet is not properly implemented. Due to an increase in the thickness, a flavor and aroma may not be sufficiently expressed. If the flavored sheet is extremely thin, it may be difficult to obtain the cooling effect.

According to an embodiment of the present disclosure, the flavored sheet may have a tensile strength that allows the flavored sheet to be applied as a component of a paper tube or a paper tube filter of a smoking article. For example, the tensile strength of the flavored sheet may be 1.0 kilogram-force (kgf)/15 mm or greater; 2.0 kgf/15 mm or greater; 5.0 kgf/15 mm or greater; or in a range of 1.0 kgf/15 mm to 10 kgf/15 mm. If the tensile strength is within the above range, a flavored sheet with a properly balanced strength and flexibility to be applicable as base paper of a paper tube of a smoking article may be obtained.

According to an embodiment of the present disclosure, the paper tube may have a resistance to draw of 0.1 $mmH_2O$ to 1.5 $mmH_2O$ per millimeter of a length. If the resistance to draw is within the above range, smoke may smoothly flow during smoking, and persistence of a smoking taste and a tobacco taste may be enhanced.

According to an embodiment of the present disclosure, the paper tube may have a circumference of 14 mm to 25 mm; 14 mm to 20 mm; or 14 mm to 18 mm, and a length of 5 mm or greater; 10 mm or greater; a length of 10 mm to 20 mm, or 10 mm to 15 mm.

According to an embodiment of the present disclosure, the paper tube may be applied as a component of the smoking article, for example, as a paper tube filter, which will be described in more detail in association with the smoking article below.

The present disclosure relates to a smoking article including a paper tube according to the present disclosure.

According to an embodiment of the present disclosure, the smoking article may include a filter portion and a smoking material portion, and the filter portion may include a flavored sheet according to the present disclosure. For example, a paper tube filter including a paper tube to which the flavored sheet according to the present disclosure is applied may be introduced, to provide a cooling effect and a flavor expression effect. In other words, the paper tube to which the flavored sheet is applied may swirl an airflow and absorb thermal energy at the same time to more easily obtain the cooling effect.

According to an embodiment of the present disclosure, the filter portion may be a dual filter or a triple filter. In addition, the filter portion may include at least one of a porous matrix structure, a hollow tube filter, and a paper tube filter.

According to an embodiment of the present disclosure, the dual filter may include a first filter, and a second filter, and the second filter may include a paper tube filter according to the present disclosure.

According to an embodiment of the present disclosure, the triple filter may include a first filter, a second filter including the paper tube, a tube filter, or a woven fabric filter; and a third filter including the paper tube, a tube filter, or a woven fabric filter. In a heating-type tobacco stick, the first filter may be disposed in a direction (e.g., a downstream direction) toward a smoker, and the second filter and the third filter may be sequentially arranged in a direction (e.g., an upstream direction) away from the smoker.

According to an embodiment of the present disclosure, the paper tube filter may include a paper tube including a flavored sheet according to the present disclosure. The flavored sheet may include a cellulose-based polymer, a plasticizer, and a flavoring material. The flavored sheet, which is a film-type sheet, may retain the flavoring material within the cellulose-based polymer to enhance persistence of a flavor and/or tobacco taste spread from a smoking article. In addition, the cellulose-based polymer may provide an airflow cooling effect due to a characteristic of a phase change (e.g., crystallization) only at a temperature (e.g., a high temperature) of an airflow traveling to a smoker in a smoking article, for example, in a stick. In addition, due to a high tensile strength and flexibility of the flavored sheet, the flavored sheet may be applied as a component of a paper tube or a paper tube filter instead of being applied to base paper.

According to an embodiment of the present disclosure, the cellulose-based polymer may be a binder material while providing a polymer matrix for forming a sheet that is flexible, that has a high tensile strength and that is capable of retaining a flavoring material, and may include, for example, at least one selected from a group consisting of methyl cellulose, ethyl cellulose, carboxymethyl cellulose, carboxyethyl cellulose, hydroxymethyl cellulose, hydroxyethyl cellulose, hydroxypropyl cellulose, hydroxypropylmethyl cellulose, hydroxyethylmethyl cellulose, and agar, but is not limited thereto. Desirably, the cellulose-based polymer may be methyl cellulose and hydroxypropylmethyl cellulose.

According to an embodiment of the present disclosure, the cellulose-based polymer may be in an amount of 20 wt % to 60 wt %; 20 wt % to 50 wt %; or 30 wt % to 40 wt % in the flavored sheet. If the amount of the cellulose-based polymer is less than 20 wt %, it may be difficult to obtain a tensile strength and flexibility that allow the cellulose-based polymer to be applied as a component of a paper tube or a paper tube filter, or difficult to generate a sheet itself. If the amount of the cellulose-based polymer exceeds 60 wt %, it may be difficult to enhance persistence of a smoking taste and a tobacco taste because an aroma and flavor are not sufficiently expressed from a flavoring material in a sheet due to a change (e.g., breaking, and cracking) in physical properties of the sheet.

According to an embodiment of the present disclosure, as the flavoring material, all materials capable of imparting flavor and/or aroma characteristics or enhancing an aromatic taste of smoking and applicable to a smoking article may be used without limitation. The flavoring material may include, for example, at least one selected from a group consisting of an organic acid, such as a lactic acid, a citric acid, a malic acid, and the like, licorice, sucrose, fructose syrup, isosweet, cocoa, lavender, cinnamon, cardamom, celery, fenugreek, cascarilla, white sandalwood, bergamot, geranium, honey essence, rose oil, vanilla, lemon oil, orange oil, mint oil, cinnamon, caraway, cognac, jasmine, chamomile, menthol, *cassia*, ylang-ylang, *salvia*, spearmint, ginger, cilantro, a clove extract (or a clove material), and coffee, but is not limited thereto.

According to an embodiment of the present disclosure, the flavoring material may be in an amount of 10 wt % to 50 wt %; 10 wt % to 40 wt %; 10 wt % to 30 wt %; or 10 wt % to 20 wt % in the flavored sheet. If the amount of the flavoring material is within the above range, persistence of a flavor and/or tobacco taste that spread may be provided and the flavoring material may be applied at a high concentration, to adjust an intensity of an aroma and/or flavor.

According to an embodiment of the present disclosure, the plasticizer may include at least one selected from a group consisting of propylene glycol, polyethylene glycol, dipropylene glycol, diethylene glycol, triethylene glycol, tetraethylene glycol, glycerin, and sorbitol, but is not limited thereto. Desirably, the plasticizer may be propylene glycol and glycerin.

According to an embodiment of the present disclosure, the plasticizer may be in an amount of 1 wt % to 20 wt %; 1 wt % to 15 wt %; 1 wt % to 10 wt %; or 5 wt % to 10 wt % in the flavored sheet to adjust a strength of the flavored sheet. If the amount of the plasticizer is less than 1 wt %, it may be difficult to have a tensile strength suitable to apply the plasticizer as a component of a paper tube or a paper tube filter of a smoking article, or difficult to have a flexibility due to an extremely low extension rate. If the amount of the plasticizer exceeds 20 wt %, a sheet may be easily torn due to poor physical properties of the sheet (e.g., a tensile strength may be reduced, or the sheet may be excessively softened), and accordingly it may be difficult to manufacture the sheet as a paper tube filter of a smoking article.

According to an embodiment of the present disclosure, the flavored sheet may have a thickness of 1 millimeter (mm) or less; 0.1 mm to 1 mm; 0.1 mm to 0.8 mm; or 0.2 mm to 0.5 mm. The flavored sheet may include a single layer or a plurality of layers. If the thickness of the flavored sheet exceeds 1 mm, it may be difficult to manufacture a sheet as a paper tube or a paper tube filter of a smoking article because a flexibility of the sheet is not properly implemented. Due to an increase in the thickness, a flavor and aroma may not be sufficiently expressed. If the flavored sheet is extremely thin, it may be difficult to obtain the cooling effect.

According to an embodiment of the present disclosure, the flavored sheet may have a tensile strength that allows the flavored sheet to be applied as a component of a paper tube or a paper tube filter of a smoking article. For example, the tensile strength of the flavored sheet may be 1.0 kgf/15 mm or greater; 2.0 kgf/15 mm or greater; 5.0 kgf/15 mm or greater; or in a range of 1.0 kgf/15 mm to 10 kgf/15 mm. If the tensile strength is within the above range, a flavored sheet with a properly balanced strength and flexibility to be applicable as base paper of a paper tube of a smoking article may be obtained.

According to an embodiment of the present disclosure, the paper tube or paper tube filter may have a resistance to draw of 0.1 $mmH_2O$ to 1.5 $mmH_2O$ per millimeter of a length. If the resistance to draw is within the above range, smoke may smoothly flow during smoking, and persistence of a smoking taste and a tobacco taste may be enhanced.

According to an embodiment of the present disclosure, the paper tube or paper tube filter may have a circumference of 14 mm to 25 mm; 14 mm to 20 mm; or 14 mm to 18 mm, and a length of 5 mm or greater; 10 mm or greater; a length of 10 mm to 20 mm, or 10 mm to 15 mm.

Figure 2:
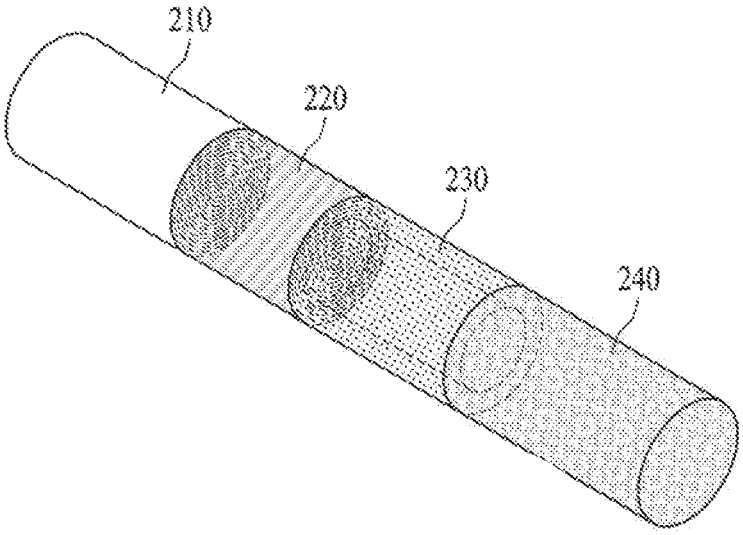
FIG. 2 illustrates another example of a smoking article to which a paper tube according to the present disclosure is applied, according to an embodiment of the present disclosure.

According to an embodiment of the present disclosure, referring to FIGS. 1 and 2, the smoking article may be a cigarette or an electronic cigarette, and may be in the form of a cigarette. Thus, by the flavored sheet, an airflow cooling effect may be obtained and an aroma and/or flavor may be expressed to enhance the persistence of the smoking taste and the tobacco taste. In other words, by applying the flavored sheet to a paper tube having a cooling function, an airflow may be swirled and thermal energy may be absorbed at the same time, so that the cooling effect may be more easily obtained.

According to an embodiment of the present disclosure, referring to FIG. 1, a smoking article may be a triple filter and may include a first filter portion 110, a second filter portion 120 including a paper tube including a flavored sheet according to the present disclosure; and a third filter portion 130 including a woven fabric filter or a tube filter. The filter portion may express a flavor and/or aroma using the flavored sheet while cooling an airflow traveling from a smoking material portion 140 in an airflow direction.

According to an embodiment of the present disclosure, the first filter portion 110, the second filter portion 120, the third filter portion 130, and the smoking material portion 140 may each have a length selected from a range of 10 mm to 20 mm; or a range of 10 mm to 15 mm.

According to an embodiment of the present disclosure, referring to FIG. 2, a smoking article may be a triple filter and may include a first filter portion 210, a second filter portion 220 including a woven fabric filter or a tube filter; and a third filter portion 230 including a paper tube including a flavored sheet according to the present disclosure. The filter portion may express a flavor and/or aroma using the flavored sheet while cooling an airflow traveling from a smoking material portion 240 in an airflow direction.

According to an embodiment of the present disclosure, the first filter portion 210, the second filter portion 220, the third filter portion 230, and the smoking material portion 240 may each have a length selected from a range of 10 mm to 20 mm; or a range of 10 mm to 15 mm.

According to an embodiment of the present disclosure, the paper tube filter may include a flavored sheet according to the present disclosure which is introduced, and the flavored sheet according to the present disclosure may be further applied to an inner wall surface of the tube filter. In addition, the woven fabric filter may include a polymer fiber, a fiber obtained by cutting the flavored sheet according to the present disclosure, or both. For example, the polymer may be a polylactic acid (PLA), cellulose acetate (CA), poly (ethylene terephthalate) (PET), and the like.

According to an embodiment of the present disclosure, the first filter may include a filter tow known in the art to which the present disclosure belongs, and may include a filter tow including a fibrous form, a filamentous form, or both, but is not limited thereto. The fibrous form and the filamentous form may each include at least one of a polymer, paper, cellulose acetate, activated carbon, and carbon.

According to an embodiment of the present disclosure, the smoking material portion may include raw tobacco materials, such as cut tobacco leaves, and the like, a smoking taste and aerosol forming substrate, and the like, and may be formed according to the type of smoking articles.

According to an embodiment of the present disclosure, the smoking article may have a diameter of 4 mm to 10 mm and a circumference of 14 mm to 29 mm. In addition, the smoking article may have a length of 45 mm to 100 mm.

While the embodiments are described with reference to drawings, it will be apparent to one of ordinary skill in the art that various alterations and modifications in form and details may be made in these embodiments without departing from the spirit and scope of the claims and their equivalents. For example, suitable results may be achieved if the described techniques are performed in a different order, and/or if described components are combined in a different manner, and/or replaced or supplemented by other components or their equivalents. Therefore, other implementations, other embodiments, and equivalents to the claims are also within the scope of the following claims.

The invention claimed is:

1. A smoking article comprising:

a filter portion comprising a paper tube, the paper tube comprising a flavored sheet, wherein the flavored sheet comprises a cellulose-based polymer, a plasticizer, and a flavoring material.

2. The smoking article of claim 1, wherein the smoking article is a cigarette or an electronic cigarette, and is in a form of a cigarette.

3. The smoking article of claim 1, wherein the filter portion comprises:

a first filter;

a second filter comprising the paper tube; and a third filter comprising a tube structure.

4. The smoking article of claim 3, wherein the first filter comprises a fibrous form, a filamentous form, or both, wherein the fibrous form and the filamentous form each comprise at least one of a polymer, paper, cellulose acetate, activated carbon, and carbon.

5. The smoking article of claim 1, wherein the cellulose-based polymer is in an amount of 20% by weight (wt %) to 60 wt % in the flavored sheet.

6. The smoking article of claim 1, wherein the plasticizer is in an amount of 1 wt % to 20 wt % in the flavored sheet.

7. The smoking article of claim 1, wherein the flavoring material is in an amount of 10 wt % to 50 wt % in the flavored sheet.

8. The smoking article of claim 1, wherein the cellulose comprises at least one selected from the group consisting of methyl cellulose, ethyl cellulose, carboxymethyl cellulose, carboxyethyl cellulose, hydroxymethyl cellulose, hydroxyethyl cellulose, hydroxypropyl cellulose, hydroxypropylmethyl cellulose, hydroxyethylmethyl cellulose, and agar.

9. The smoking article of claim 1, wherein the plasticizer comprises at least one selected from the group consisting of propylene glycol, polyethylene glycol, dipropylene glycol, diethylene glycol, triethylene glycol, tetraethylene glycol, glycerin, and sorbitol.

* * * * *